United States Patent [19]

Knecht

[11] Patent Number: 5,046,295

[45] Date of Patent: Sep. 10, 1991

[54] CIGARETTE PACKAGING METHOD AND APPARATUS

[75] Inventor: Siegfried Knecht, Gevelsberg, Fed. Rep. of Germany

[73] Assignee: Maschinenfabrik Alfred Schmermund GmbH & Co., Gevelsberg, Fed. Rep. of Germany

[21] Appl. No.: 627,709

[22] Filed: Dec. 14, 1990

[30] Foreign Application Priority Data

Dec. 16, 1989 [DE] Fed. Rep. of Germany ..... 3941601

[51] Int. Cl.[5] ..... B65B 51/00

[52] U.S. Cl. ..... 53/202; 53/234; 53/387.2; 198/418.1; 198/450

[58] Field of Search ..... 53/148, 202, 225, 234, 53/387.2, 387.3; 198/418.1, 450

[56] References Cited

U.S. PATENT DOCUMENTS

| | | | |
|---|---|---|---|
| 4,718,216 | 1/1988 | Focke et al.* | 53/202 X |
| 4,768,639 | 9/1988 | Ganberini | 53/234 X |
| 4,840,007 | 6/1989 | Focke et al. | 53/202 X |
| 4,889,226 | 12/1989 | Deutsch | 198/450 |

FOREIGN PATENT DOCUMENTS

| | | | |
|---|---|---|---|
| 589257 | 12/1959 | Canada | 198/250 |

*Primary Examiner*—John Sipos

*Attorney, Agent, or Firm*—Chilton, Alix & Van Kirk

[57] ABSTRACT

In the formation of cigarette packages, glued and folded packages are delivered via a pair parallel conveyors to a transfer device which includes a pair rotatable transfer turrets. The axes of rotation of the transfer turrets are offset both vertically and horizontally such that a pair of packages simultaneously received from the two conveyors may subsequently be simultaneously transferred into a pair of adjacent receiving spaces in a double cell of a drying turret.

17 Claims, 3 Drawing Sheets

CIGARETTE PACKAGING METHOD AND APPARATUS

BACKGROUND OF THE INVENTION

1. Field of the Invention

This invention is directed to the packaging of cigarettes and particularly to enhancing the speed and efficiency of performance of a drying step, which results in the curing of an adhesive which has been applied to a folded outer wrapper, in order to complete the formation of a cigarette package. More specifically, the present invention relates to cigarette packaging apparatus, especially apparatus which is employed in the formation of hinged-lid-packages, wherein the glued and folded packs arrive at a drying station on a pair of conveyors and are transferred from the conveyors into a drying turret which may have multiple stages. Accordingly, the general objects of the present invention are to provide novel and improved methods and apparatus of such character.

2. Description of the Prior Art

While not limited thereto in its utility, the present invention is particularly well suited for employment in the packaging of cigarettes in so-called hinged lid packs. In the formation of such a pack, individual cigarettes are formed into a block which is wrapped in an inner paper to form an inner bundle. A hinged-lid box is then folded from a pre-formed blank about the inner bundle and, during the folding process, adhesive is applied to portions of the blank. The thus formed and adhesively coated box is held in a closed position, during a drying step, until the adhesive has cured.

To amplify on the above-briefly described packaging process, cigarettes are delivered via a funnel into cells of a block turret to form blocks. The thus formed cigarette blocks are transferred to cells on a wrapping turret about which an inner-paper is wrapped. The outer box is then folded, from a pre-cut blank, about the inner wrapper and adhesively coated as required. Finally, the boxes which have been folded about the wrapped cigarette blocks are transferred into a drying turret. In the typical packaging operation, the drying turret is a multistage device and the formed packs are pushed into a first row or stage and, after an appropriate rotation, are pushed into a second stage or row. After the appropriate drying time, which may dictate that the packs be transferred to a third stage of the drying turret, the completed packages are ejected from the drying turret. An efficient, and thus high speed, packaging process may dictate that the folded and glued cigarette packs arrive at the drying station on a pair of conveyors. Obviously, where there are two parallel package formation lines, a separate drying turret may be installed for each conveyor. The use of two drying turrets, however, is expensive and occupies substantial floor space. As an alternative, a single drying turret may be associated with both conveyors with the turret being filled at two separated points corresponding to the ends of the conveyors. The latter arrangement, however, leads to the undesirable result of unequal dwell times for the packs in the drying turret.

SUMMARY OF THE INVENTION

The present invention overcomes the above-discussed and other deficiencies and disadvantages of the prior art by providing a cigarette-packaging technique, and apparatus for use in the implementation of that technique, wherein packs being delivered to a drying station on two conveyors may transferred into a single drying turret efficiently. Apparatus in accordance with the invention is characterized by modest cost and space requirements.

Apparatus in accordance with a preferred embodiment of the invention employs a drying turret wherein the package receiving cells are in the form of radially aligned double cells which are located adjacent to one another in the circumferential direction. Thus, each cell of the drying turret defines two receiving spaces for accepting cigarette packs. The invention also comprises a transfer device which includes a pair of rotatable transfer turrets. Each transfer turret carries a plurality of pack receiving cells. The transfer device turrets are arranged with their axes parallelly oriented. The transfer device further includes a double slide which simultaneously moves packs from one cell on each of the transfer device turrets into the receiving spaces of a double cell on the drying turret. The spacing of the axes of rotation of the turrets of the transfer device relative to one another and relative to the axis of rotation of the drying turret is selected such that, in the position where packs are transferred to the drying turret, cells on the two transfer turrets are positioned adjacent to one another and, typically, are in vertical alignment.

Thus, in accordance with the invention, the use of a pair of specially designed transfer turrets enables cigarette packs which are arriving on a pair of parallel conveyors to be transferred in pairs to double cells of a drying turret. Accordingly, the dwell time in the drying turret of the packs arriving at the same time at the transfer device on the two conveyors will always be the same.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures, and in which.

DESCRIPTION OF THE DISCLOSED EMBODIMENT

Figure 3:
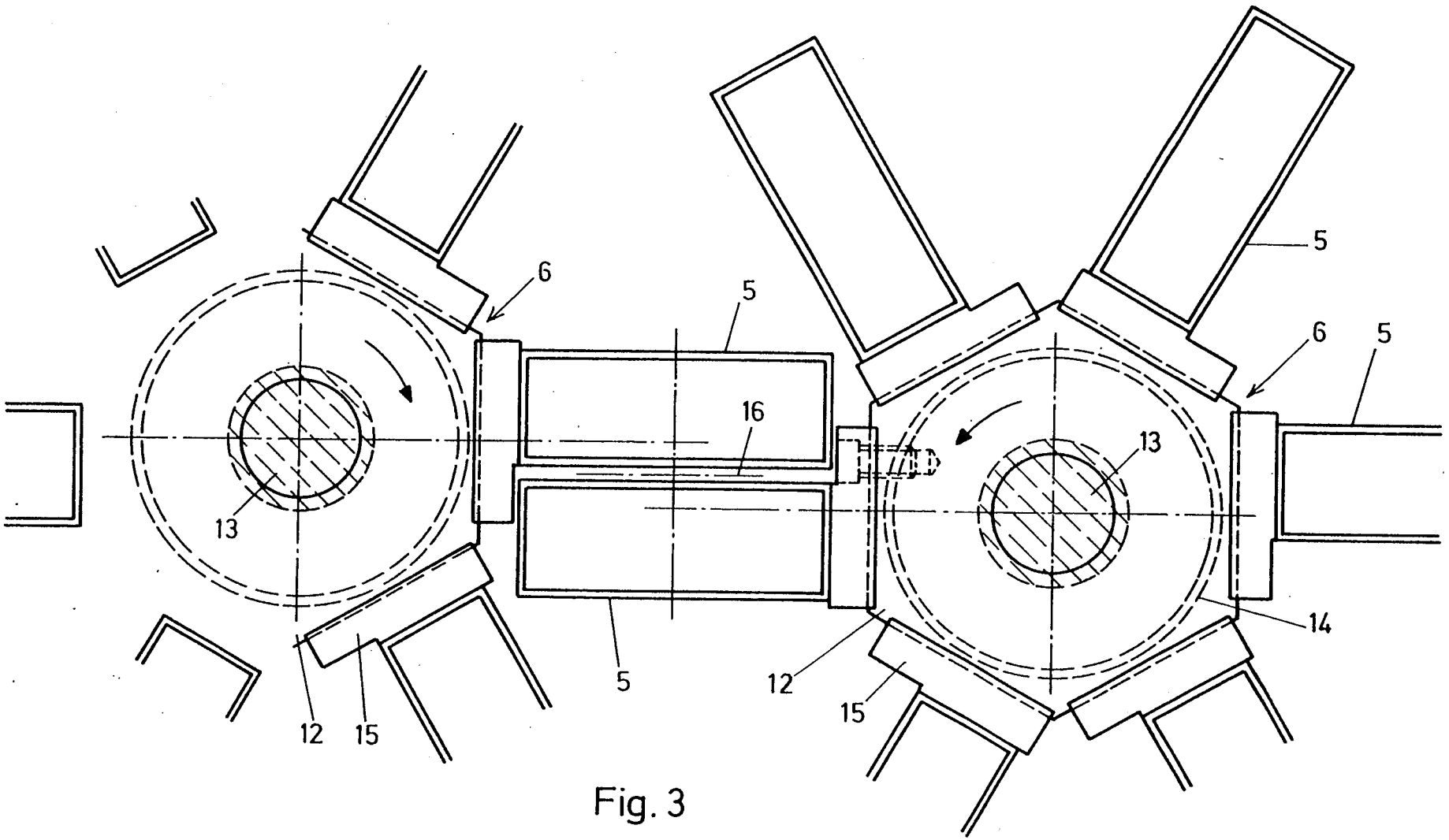
FIG. 3 is a partial front view, looking from the drying turret, of the transfer station of the apparatus of FIGS. 1 and 2.

With reference now to the drawings, partially formed cigarette packages which comprise a block of cigarettes wrapped in an inner paper and a partially folded outer package defining blank are produced on a cigarette packaging apparatus which is not depicted in the drawing. These partially formed packages are delivered to a pair of parallel conveyors 1. The conveyors 1 transport the partially formed packages successively through adhesive-coating devices 2 and folding deflectors 3. The packages exit the folding deflectors 3 in their final closed form but with the adhesive not having cured sufficiently to be guaranteed to retain the packages in this form. The closed packages, indicated at 4, are pushed into cells 5 of transfer turrets 6, there being a transfer turret associated with each conveyor 1. The transfer turrets are rotated to cause the cells 5 to be moved, in stepwise fashion, into alignment with the conveyors 1 so as to receive the packages. The transfer turrets 6, as may best be seen from FIG. 3, are mounted on shafts 13 which define parallel axes of rotation. The turrets 6 are supported on a machine stand 7. The turrets 6 will be rotated in opposite directions with each step corresponding to the spacing between the equidistantly arranged cells 5.

Continuing to refer to FIG. 3, the spacing of the axes of rotation of the turrets 6 results in the cells 5 on the two turrets being interleaved so as to place a pair of cells in adjacent vertical alignment. In order to enable the interleaving and vertical alignment, the axes of shafts 13 of the two turrets 6 are offset, to opposite sides of a horizontal plane which extends through the axis of rotation 16 of a drying turret 8, by distances which are determined by the distance between the receiving spaces 17 of the double cells 9 of the drying turret 8. The relationship between the axes of rotation of the transfer turrets and the drying turret will be described in greater detail below.

Figure 1:
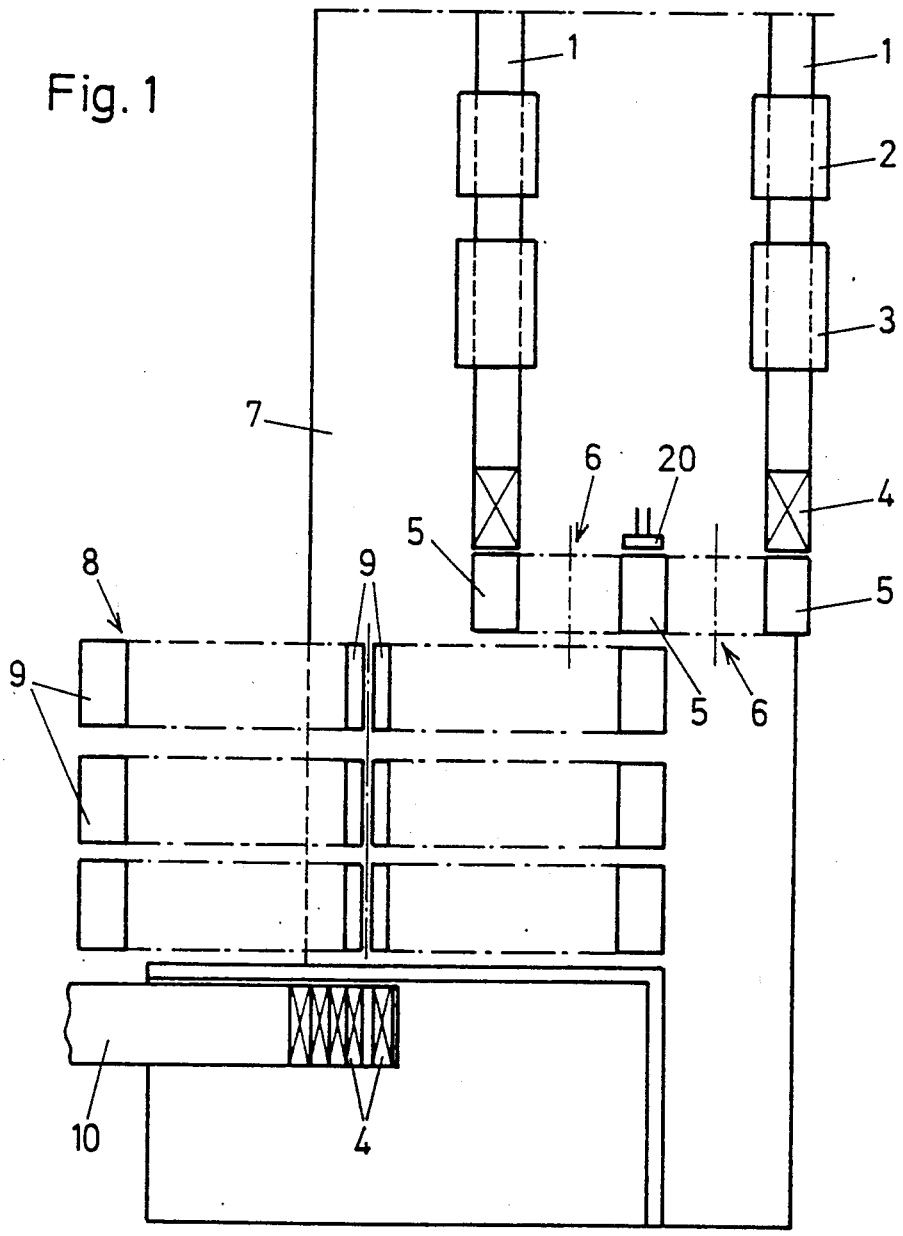
FIG. 1 is a schematic, top view of apparatus in accordance with a first embodiment of the invention.

As noted, in the direction of pack movement, a drying turret 8 is located downstream of the transfer turrets 6. In the disclosed embodiment, as may best be seen from FIG. 1, the drying turret 8 is of three-row or stage design and is equipped with double cells 9 which receive the packs 4. In operation, the packs are received in the first row of the drying turret, rotated through 270° , and are then pushed over into the second row where they are retained through a 360° rotation. Thereafter, the packs are pushed into the third row of the drying turret, again held in the drying turret through 360° of rotation, and finally the packs are pushed out of the drying turret onto a discharge conveyor 10. The drying turret 8 is mounted on an axle and rotatable about axis 16 in steps which each correspond to one double-cell division.

The double cells 9 of the rows of the drying turret are arranged next to one another in the circumferential direction. Cells 9 are axially open so that the packs can be moved from row to row in succession in the axial direction. The receiving spaces of each of the double cells on the drying turret, in order be capable of registration with the interleaved cells of the transfer turrets as depicted in FIG. 3, are arranged symmetrically with respect to the radius of drying turret which extends through the double cell.

Returning again to a consideration of the transfer turrets 6, and with reference to FIG. 3, each of the turrets 6 comprises a hexagonal plate 12 which is fastened to a respective drive shaft 13. The shafts 13 each carry a drive gear 14. A cell holder 15, each of which accepts a cell 5, is affixed to each of the six sides of the plates 12. The cells 5 are open only a pair of oppositely disposed ends. When located at their outermost positions, i.e., at the positions oppositely disposed with respect to the region between the shafts 13, a cell 5 on a turret 16 will be aligned to receive a pack arriving on a conveyor 1. As may be seen from FIG. 3, the cells are eccentrically mounted in the holders 15 so as to to be laterally offset with respect to the associated side of the hexagonal plates 12. Furthermore, as discussed above, the axes of rotation of the two transfer turrets 6, i.e., the axes of the shafts 13, are parallel but symmetrically opposite with respect to a horizontal plane through the axis of rotation 16 of the drying turret 8. In the disclosed embodiment, where the cells 15 are vertically aligned at the point of transfer of the cigarette packages to the drying turret, the axes of rotation of the turrets 6 are vertically offset as a function of the distance between the receiving spaces 17 of the double cells of the drying turret 8. The horizontal spacing of the axes of rotation of the turrets 6 is such that a pair of cells 5 may be arranged adjacent to and above one another with their walls in a parallel relationship. This horizontal and vertical spacing will place the open end faces of the interleaved cells 5 in registration with the open end faces of the receiving spaces of a respective double cell 9 of the drying turret 8. The two cells 5 located in the receiving positions relative to the transport conveyors 1 extend horizontally and are parallel so that, in spite of the fact that the adjacent vertically aligned cells located in the position of transfer to the drying turret are vertically staggered, the transport conveyors 1 may be arranged at the same height.

Figure 2:
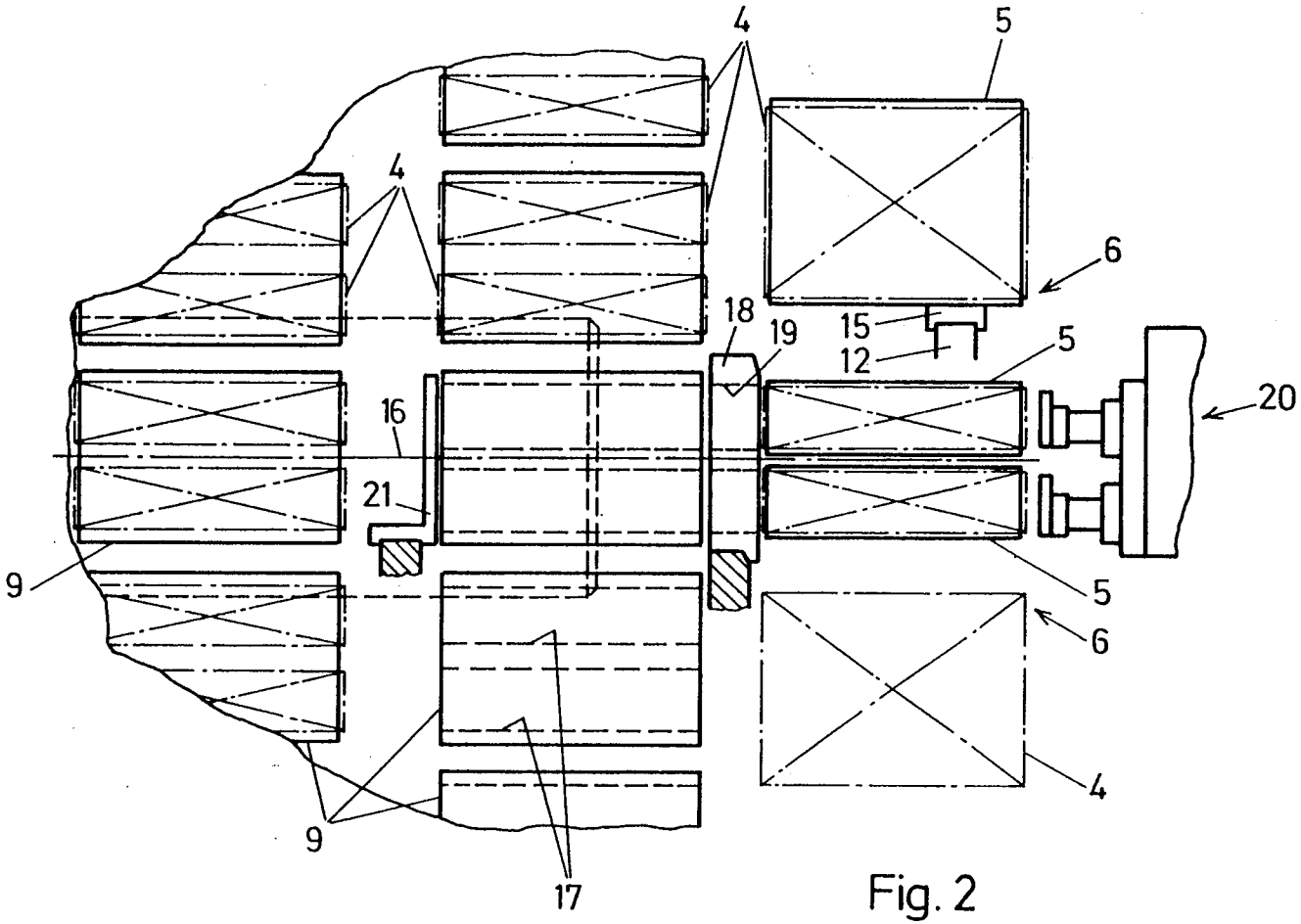
FIG. 2 is a partial side elevation view, partly broken away to show detail, of the apparatus of FIG. 1.

Referring to FIG. 2, a mouthpiece 18 is located between the interleaved transfer turrets 5 and drying turret 8. The mouthpiece 18 is provided with a pair of passages 19 which guide the cigarette packages 4 as they are pushed over from the cells 5 into a double cell 9 on the drying turret which is arranged symmetrically relative to the horizontal plane through axis 16. The transfer from the transfer turrets 6 to the drying turret 8 via the mouthpiece 18 is accomplished through the use of a double slide 20. Slide 20 may, for example, be activated via a crank mechanism. A stop 21 is located behind the first row of double cells on the drying turret.

It is to be noted that if the cells 5 of the transfer turret 6 are to be arranged in a horizontal alignment, it is necessary to provide for there to be an even number of such cells.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a cigarette packaging machine, the machine including a pair of conveyors for transporting formed and glued cigarette packs to a dryer wherein the glue will set, the improvement comprising:

at least a first rotatable drying turret, said drying turret having a plurality of spatially displaced cells located about its circumference, each of said drying turret cells defining a pair of open-ended pack receiving spaces, opposed sidewalls which define each of said receiving spaces being substantially parallel to one another;

means for transferring packs from the conveyors to said first drying turret, said transferring means including:

a first rotatable transfer turret, said first transfer turret carrying a plurality of open-ended cells which are each sized and shaped to receive a pack, said first transfer turret having an axis of rotation and being positioned relative to a first of the conveyors so that packs may be transferred from the first conveyor into cells of said first transfer turret when the transfer turret cells are rotated into a receiving position where they are juxtapositioned to the conveyor during stepwise rotation of said first transfer turret, said first transfer turret also being positioned such that cells thereon may be placed in registration with a first receiving space of a cell on said first drying turret; and a second rotatable transfer turret, said second transfer turret carrying a plurality of open-ended cells which are each sized and shaped to receive a pack, said second transfer turret having an axis of rotation and being positioned relative to the second conveyor so that packs may be transferred from the second conveyor into cells of said second transfer turret when the cells are rotated into a receiving position where they are juxtapositioned to the second conveyor during stepwise rotation of said second transfer turret, said second transfer turret also being positioned such that cells thereon may be placed in registration with a second receiving space of a cell on said drying turret, the axis of rotation of said second transfer turret being parallel to but spaced from the axis of rotation of said first transfer turret, the spacing of said axes being selected such that a pair of cells respectively on said first and second transfer turrets will be located adjacent to one another and substantially parallel to one another when said cells are in registration with respective receiving spaces of a cell on said drying turret; and double slide means for simultaneously transferring a pair of cigarette packs from adjacent transfer turret cells into the receiving spaces of a drying turret cell.

2. The apparatus of claim 1 wherein the axes of rotation of said first and second transfer turrets are arranged symmetrically relative to a horizontal plane through the axis of rotation of the drying turret, said axes of rotation of said transfer turrets being vertically offset from one another by a distance which is function of the distance between the receiving spaces of the cells of the said drying turret.

3. The apparatus of claim 1 further comprising:

guide means positioned between said drying turret and said transfer turrets, said guide means being located such that it will be generally in alignment with a pair of adjacent transfer turret cells and a drying turret cell.

4. The apparatus of claim 2 further comprising:

guide means positioned between said drying turret and transfer turrets, said guide means being located such that it will be generally in alignment with a pair of adjacent transfer turret cells and a drying turret cell.

5. The apparatus of claim 1 further comprising:

stop means located behind said drying turret and positioned to be in registration with the drying turret cell which is oriented to received cigarette packs from a pair of adjacent transfer turret cells.

6. The apparatus of claim 2 further comprising:

stop means located behind said drying turret and positioned to be in registration with the drying turret cell which is oriented to received cigarette packs from a pair of adjacent transfer turret cells.

7. The apparatus of claim 3 further comprising:

stop means located behind said drying turret and positioned to be in registration with the drying turret cell which is oriented to received cigarette packs from a pair of adjacent transfer turret cells.

8. The apparatus of claim 4 further comprising:

stop means located behind said drying turret and positioned to be in registration with the drying turret cell which is oriented to received cigarette packs from a pair of adjacent transfer turret cells.

9. The apparatus of claim 1 wherein each of said transfer turrets includes a polygonal plate arranged concentrically with respect to the axis of rotation of the turret, said plate having an even number of sides, a cell being mounted eccentrically on each of said sides.

10. The apparatus of claim 2 wherein each of said transfer turrets includes a polygonal plate arranged concentrically with respect to the axis of rotation of the turret, said plate having an even number of sides, a cell being mounted eccentrically on each of said sides.

11. The apparatus of claim 3 wherein each of said transfer turrets includes a polygonal plate arranged concentrically with respect to the axis of rotation of the turret, said plate having an even number of sides, a cell being mounted eccentrically on each of said sides.

12. The apparatus of claim 4 wherein each of said transfer turrets includes a polygonal plate arranged concentrically with respect to the axis of rotation of the turret, said plate having an even number of sides, a cell being mounted eccentrically on each of said sides.

13. The apparatus of claim 5 wherein each of said transfer turrets includes a polygonal plate arranged concentrically with respect to the axis of rotation of the turret, said plate having an even number of sides, a cell being mounted eccentrically on each of said sides.

14. The apparatus of claim 6 wherein each of said transfer turrets includes a polygonal plate arranged concentrically with respect to the axis of rotation of the turret, said plate having an even number of sides, a cell being mounted eccentrically on each of said sides.

15. The apparatus of claim 7 wherein each of said transfer turrets includes a polygonal plate arranged concentrically with respect to the axis of rotation of the turret, said plate having an even number of sides, a cell being mounted eccentrically on each of said sides.

16. The apparatus of claim 8 wherein each of said transfer turrets includes a polygonal plate arranged concentrically with respect to the axis of rotation of the turret, said plate having an even number of sides, a cell being mounted eccentrically on each of said sides.

17. The apparatus of claim 1 wherein said transfer turret axes of rotation are offset from one another in two mutually orthogonal directions, a first of said directions being determined by a plane defined by the conveyors and the spacing in the second of said directions being determined by the dimensions of the drying turret cells.

* * * * *